United States Patent [19]

Hsieh et al.

[11] Patent Number: 4,655,781

[45] Date of Patent: Apr. 7, 1987

[54] STABLE BLEACHING COMPOSITIONS

[75] Inventors: Chung-Lu Hsieh, San Ramon; Stephen B. Kong, Alameda; Dale S. Steichen; Harold R. Wheeler, both of Livermore, all of Calif.

[73] Assignee: The Clorox Company, Oakland, Calif.

[21] Appl. No.: 626,825

[22] Filed: Jul. 2, 1984

[51] Int. Cl.[4] ..... D06L 3/02; D06L 3/04; C11D 3/395

[52] U.S. Cl. ..... 8/111; 252/95; 252/96; 252/99; 252/186.26; 8/101

[58] Field of Search ..... 252/95, 99, 96, 367, 252/368, 186.26; 8/111

[56] References Cited

U.S. PATENT DOCUMENTS

| | | | |
|---|---|---|---|
| 2,287,064 | 6/1942 | Reichert et al. | 252/186.1 |
| 3,075,921 | 1/1963 | Brocklehurst et al. | 252/99 |
| 3,143,562 | 8/1964 | Silbert et al. | 260/465 |
| 3,321,512 | 5/1967 | Cooper et al. | 260/502 |
| 3,494,786 | 2/1970 | Nielsen | 117/100 |
| 3,494,787 | 2/1970 | Lund et al. | 117/100 |
| 3,639,285 | 2/1972 | Nielsen | 252/100 |
| 3,655,738 | 4/1972 | Nielsen | 260/502 R |
| 3,770,816 | 11/1973 | Nielsen | 260/502 R |
| 3,819,688 | 6/1974 | Silbert et al. | 260/502 R |
| 3,880,914 | 4/1975 | Nielsen | 260/502 R |
| 3,956,159 | 5/1976 | Jones | 252/104 |
| 3,975,280 | 8/1976 | Hachmann et al. | 252/102 |
| 4,006,029 | 2/1977 | Guile et al. | 106/58 |
| 4,013,575 | 3/1977 | Castrantas et al. | 252/104 |
| 4,013,581 | 3/1977 | Huber | 252/186 |
| 4,085,133 | 4/1978 | Briody | 260/502 R |
| 4,088,676 | 5/1978 | Hofen et al. | 260/502 R |
| 4,091,544 | 5/1978 | Hutchins | 34/9 |
| 4,100,095 | 7/1978 | Hutchins et al. | 252/99 |
| 4,119,660 | 10/1978 | Hutchins | 260/502 R |
| 4,126,573 | 11/1978 | Johnston | 252/99 |
| 4,170,453 | 10/1979 | Kitko | 8/111 |
| 4,172,086 | 10/1979 | Berkowitz | 260/406 |
| 4,233,235 | 11/1980 | Camden et al. | 260/502 R |
| 4,244,884 | 1/1981 | Hutchins et al. | 260/502 R |
| 4,259,201 | 3/1981 | Cockrell, Jr. et al. | 252/103 |
| 4,287,135 | 9/1981 | Stober et al. | 260/502 R |
| 4,314,949 | 2/1982 | Bettle, III et al. | 260/502 R |
| 4,337,213 | 6/1982 | Marynowski et al. | 260/502 R |
| 4,370,251 | 1/1983 | Liao et al. | 42/186.42 |
| 4,374,035 | 2/1983 | Bossu | 252/191 |
| 4,385,008 | 5/1983 | Hignett | 260/502 |
| 4,391,723 | 7/1983 | Bacon et al. | 252/90 |
| 4,391,724 | 7/1983 | Bacon | 252/90 |
| 4,391,725 | 7/1983 | Bossu | 252/90 |
| 4,443,352 | 4/1984 | Broze et al. | 252/94 |
| 4,473,507 | 9/1984 | Bossu | 260/502 R |
| 4,482,349 | 11/1984 | Mayer | 8/111 |
| 4,487,723 | 12/1984 | Mayer | 260/502 R |

FOREIGN PATENT DOCUMENTS

| | | |
|---|---|---|
| 635620 | 1/1962 | Canada . |
| 0068547 | 1/1983 | European Pat. Off. . |
| 70067 | 1/1983 | European Pat. Off. . |
| 70066 | 1/1983 | European Pat. Off. . |
| 68547 | 1/1983 | European Pat. Off. . |
| 75419 | 3/1983 | European Pat. Off. . |
| 73541 | 3/1983 | European Pat. Off. . |
| 83560 | 7/1983 | European Pat. Off. . |
| 7109629 | 7/1971 | Netherlands . |

OTHER PUBLICATIONS

Monsanto Industrial Chemical Company, "Alkyl-butanediperoxoic Acid (Alkyl-BUDIPA), A Peroxy Bleaching Agent".

W. D. Emmons, Peroxytrifluoroacetic Acid, I, The Oxidation of Nitrosamines to Nitramines," J.A.C.S., vol. 76, pp. 3468–3470, (1954).

D. Swern et al, "Peroxides, III, Structure of Aliphatic Peracids . . . Etc.," J.A.C.S., vol. 77, pp. 5537–5541, (1955).

W. D. Emmons et al, "Peroxytrifluoroacetic Acid, III, the Hydroxylation of Olefins," J.A.C.S., vol. 76, pp. 3472–3474, (1954).

W. D. Emmons, "Peroxytrifluoroacetic Acid, II, the Oxidation of Anilines to Nitro-Benzenes," vol. 76, pp. 3470–3472, (1954).

A. Ault, Techniques and Experiments for Organic Chemistry, 2nd ed., 1976, pp. 19–28.

S. N. Lewis, "Peracid and Peroxide Oxidations," in: *Oxidation*, 1969, pp. 213–258.

K. Balenovic et al, "Asymmetric Synthesis of Sulphoxides with α-Substituted Monoperglutaric Acids," *Chemistry and Industry*, Apr. 15, 1961, pp. 469–470.

M. F. Hawthorne et al, "A Re-Examination of the Peroxyacid Cleavage of Ketones, II, Kinetics of Baeyer-Villiger Reaction," J.A.C.S., vol. 80, pp. 6398–6404, (1958).

M. F. Hawthorne et al, "A Re-Examination of the Peroxyacid Cleavage of Ketones, I, Relative Migratory Aptitudes," *J.A.C.S.*, vol. 80, pp. 6393–6398, (1958).

W. E. Parker et al, "Peroxides, IV, Aliphatic Diperacids," *J.A.C.S.*, vol. 79, pp. 1929–1931, (1957).

*Primary Examiner*—Paul Lieberman
*Assistant Examiner*—John F. McNally
*Attorney, Agent, or Firm*—Joel J. Hayashida; Stephen M. Westbrook

[57] ABSTRACT

This invention provides stable peroxyacid bleaching compositions comprising:

(a) a surface active peroxyacid, and (b) at least one surfactant which forms a mixed micelle in aqueous solution with said peroxyacid;

wherein said aqueous solution contains a detergent concentration of about 0.1 to 3.0 grams/liter.

Buffers and other typical cleaning adjuncts known to those skilled in the art may be included.

The invention also provides a method of stabilizing the decomposition rate of surface active peroxyacids.

25 Claims, No Drawings

STABLE BLEACHING COMPOSITIONS

DESCRIPTION

TECHNICAL FIELD

This relates to surface active peroxyacids useful for bleaching and means of substantially decreasing their decomposition in aqueous solution.

BACKGROUND OF THE INVENTION

Although some surface active bleaching compositions have been introduced for various applications, stability problems and other attendant difficulties have prevented their widespread use.

SUMMARY OF THE INVENTION

It has been surprisingly discovered that the decomposition of certain surface active peroxyacids can be stabilized or affected by the addition of certain surfactants. By addition of these surfactants, second order decomposition rates of the selected peroxyacids in aqueous medium can be significantly reduced. As a result, greatly increased amounts of available oxygen of these peroxyacids is present for use.

In one embodiment of this invention is provided a stable peroxyacid bleach composition comprising:

(a) a surface active peroxyacid, and (b) at least one surfactant which forms a mixed micelle in aqueous solution with said peroxyacid;

wherein said aqueous solution contains a detergent concentration of about 0.1 to 3.0 grams/liter.

In yet another embodiment of the invention, is provided a stable peroxyacid bleach composition comprising:

(a) a surface active peroxyacid having a carbon chain of from 6 to 20 carbon atoms;

(b) at least one surfactant which forms a mixed micelle in aqueous solution with said peroxyacid; and (c) a buffer to keep the composition within the range of pH 7–12 when in aqueous solution with detergent;

wherein said aqueous solution contains a detergent concentration of about 0.1 to 3.0 grams/liter.

This invention also includes a method for stabilizing the decomposition rate of peroxyacids comprising;

(a) combining a surface active peroxyacid with at least one surfactant; and (b) forming a mixed micelle in aqueous solution therebetween;

wherein said aqueous solution contains a detergent concentration of about 0.1 to 3.0 grams/liter.

Lastly, is provided a method for bleaching soiled fabrics comprising:

treating a soiled fabric with a composition which comprises:

(a) a surface active peroxyacid;

(b) at least one surfactant which forms a mixed micelle in aqueous solution with said peroxyacid; and removing the soil from said soiled fabric;

wherein said aqueous solution contains a detergent concentration of about 0.1 to 3.0 grams/liter.

DETAILED DESCRIPTION OF THE INVENTION

The applicants have discovered that under certain conditions, the dispersion of various surface active peroxyacids in aqueous solution will lead to unexpectedly swift decomposition, leading to loss of available oxygen. This heretofore unrecognized problem has been solved by the present invention which stabilizes these decomposition rates by the addition of particular surfactants. Many different examples of these peroxyacids were inspected at various pH's and temperatures. In certain cases, especially with regard to the alkyl diperoxysuccinic acid decompositions, it was noted that at temperatures lower than that for the typical warm water wash (70° F. or 21.1° C.) that the decomposition rate was even swifter than at higher temperatures. This led to the proposal that the particular peroxyacids studied may form micelles in aqueous solution. These micelles have the effect of localizing the peroxyacid head groups (i.e., the peroxo moieties, $$-\overset{\overset{\displaystyle O}{\|}}{C}-O-OH).$$

It is speculated that the presence of these exposed peroxo groups in close proximity to each other increases the decomposition rate. The foregoing theory is believed to be ascertained by the experiments in the EXPERIMENTAL section which follows, however, the applicants herein do not intend to be bound thereby, as the complex reaction kinetics of these particular systems may give rise to yet other plausible theories which at present have not yet been discovered.

Just as significantly, at certain pH's, the surface active peroxyacids are particularly effective. These pH's correspond to the $pK_a$'s of such surface active peroxyacids. According to theory, which applicants again advance, but by which they do not wish to be bound, peroxyacid moieties in aqueous solution dissociate as follows:

$$R-\overset{\overset{\displaystyle O}{\|}}{C}-O-OH \overset{K}{\rightleftharpoons} R-\overset{\overset{\displaystyle O}{\|}}{C}-O-O^- + H^+$$

wherein K is the equilibrium constant.

and, accordingly, when 50% of dissociation is reached, is measured as the $pK_a$. Optimal performance is believed to be reached at pH's close to the $pK_a$. For certain surface active peroxyacids, such $pK_a$'s are believed to be in range of pH 8.5–9.5. Simultaneously, the normal pH found in American laundry machines is around pH 8–10. As previously mentioned, optimal activity, hence optimal bleaching, may occur at pH 8.5–9.5. However, it is within this critical range that increased decomposition of the surface active peroxyacids was noted. The problem faced was how to preserve an effective amount of peroxyacid at these pH's.

Thus, in aqueous solution, organic peroxyacids are not noted for their stability and may lose available oxygen. Further, although previously unknown in the art, it has recently been discovered that certain peroxyacids, particularly surface active alkyl peroxyacids may undergo extremely rapid solution decomposition when they are dispersed in water. While the solution kinetics of alkyl peroxyacids in aqueous solution are complex and not completely understood, it is believed that such surface active alkyl peroxyacids form micelles wherein the reactive head groups are oriented to the exterior of such micelles and, may be caused to decompose more rapidly due to a localized high peroxyacid concentration. This in turn is believed to enhance intermolecular decomposition. These particular problems have never been previously recognized in the art.

Many references have shown the combination of a peroxyacid with a surfactant (see for example, U.S. Pat. No.4,374,035, issued to Bossu). Surfactants are normally present as either the normal constituents of a laundry detergent or bleaching product, or, as in the case of U.S. Pat. No. 4,374,035, as a formulation ingredient to delay the release of the active bleaching species. However, there has been no recognition in the art that such surfactants prevent the rapid decomposition of surface active peroxyacids in aqueous solution.

Surprisingly, the addition of a surfactant capable of forming a mixed micelle with said peroxyacids in aqueous solution has been found to stabilize these peroxyacids. By mixed micelles, it is to be understood that when two surface active molecules are combined, they may form micelles together. The mixed micelles are believed to be present if stability, i.e., loss of available oxygen is controlled or diminished. This can be observed if half-life of the peroxyacid is increased. Further, addition of the surfactants appears to decrease the decomposition rate and thus improves the amount of available oxygen for enhanced bleaching performance. It is believed that the use of these surfactants in principle forms mixed micelles with the peroxyacids resulting in the decrease of intermolecular interactions among peroxy acid molecules and thus decreases the decay rates. The result of stabilizing these peroxyacids is that higher active concentrations of peroxyacids remain when they are in a wash water solution. This has the salutary benefit of greatly increasing the performance of these peroxyacids on stained fabrics as opposed to non-stabilized peroxyacids in aqueous solution. The many types of each individual component of these stable peroxyacid bleach compositions of this invention are described as follows:

1. Peroxyacids:

Suitable surface active peroxyacids include those monoperoxyacids having from 6 to 20 carbon atoms in the carbon chain. Suitable monoperoxyacids include for example perhexanoic, peroctanoic, pernonanoic, perdecanoic, and perdodecanoic (perlauric) acids.

Examples of further suitable peroxyacids are the alpha substituted alkyl monoperoxy and diperoxyacids, such as alkyl diperoxysuccinic acid, shown in Published European Patent Application No. 0083 056, whose disclosure is incorporated herein by reference. A representative example of an alpha or beta substituted monoperoxyacid is $\alpha$ or $\beta$ alkyl monoperoxysuccinic acid containing 6–20 carbon chains in the alkyl group which is the subject of co-pending U.S. patent application Ser. No. 626,826, filed July, 2, 1984, entitled "ALKYL MONOPEROXYSUCCINIC ACID BLEACHING COMPOSITIONS AND PROCESS FOR SYNTHESIZING THEREFOR," commonly owned by the assignee of the invention herein, The Clorox Company, whose disclosure is incorporated herein by reference.

Yet other examples of the preferred peroxyacids used herein include substituted or unsubstituted arylperoxyacids with an alkyl group of 6 to 20 carbon atoms. An example thereof is the peroxyacid having the following structure:

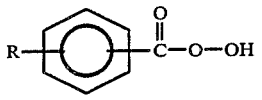

wherein R is a carbon chain comprising 6 to 20 carbon atoms. Mixtures of the above peroxyacids may also be useful in the inventive composition.

The common property possessed by all the foregoing examples of preferred peroxyacids appears to be that all must be surface active. Those surface active peroxyacids may also be classified as hydrophobic bleaches. A "hydrophobic" bleach has been defined in Published European Patent Application 0 068 547 (the disclosure of which is incorporated herein by reference) as "one whose parent carboxylic acid has a measurable CMC (critical micelle concentration) of less than 0.5M." This definition assumes that the CMC will be measured in aqueous solution at 20° C.–50° C. As will be more explicitly discussed in the ensuing description, it appears essential that the peroxyacids of this invention form micelles in aqueous solution. It is this particular phenomenon which causes the heretofore unknown rapid decomposition rates of the peroxyacids. This rapid decomposition is remedied by the addition of the surfactants disclosed in this invention.

2. Surfactants:

Suitable surfactants for use in stabilizing the peroxyacids of this composition are selected from anionic, nonionic, amphoteric, and zwitterionic surfactants and mixtures thereof. Various anionic, nonionic, amphoteric, and zwitterionic surfactants and mixtures thereof appear to significantly affect the decomposition rates of the peroxyacids of this invention.

Anionic surfactants suitable for use in this invention generally include fatty acids, their alkali metal and ammonium salts and their ethoxylated homologs having about 8–20 carbon atoms in their alkyl chain lengths; substituted and unsubstituted alkyl sulfonates; substituted and unsubstituted alkyl benzene sulfonates (examples of which include both "HLAS", for alkylbenzene sulfonic acid, and "LAS", for linear alkyl benzene sulfonate, sodium salt). Still other suitable anionic surfactants include anionic aminocarboxylates, such as N-acyl-sarcosinates, alkyl, aryl, and alkyaryl sarcosinates; alpha-olefin sulfonates; sulfates of natural fats and oils (e.g., castor, coconut, tallow oils); sulfated esters; ethoxylated and sulfated alkylphenols; ethoxylated and sulfated alcohols (also known as alkyl ether sulfates) and phosphated esters which are generally phosphorylated nonionics such as ethoxylated alcohols, ethoxylated alkylphenols, and polyoxythylene-polyoxypropylene block co-polymers.

It has been found that particularly preferred anionic surfactants used in this invention are fatty acids and their alkali metal salts having at least 8 carbon atoms in their alkyl group. Of these, particularly preferred are the potassium salts, such as potassium palmitate, myristate, and stearate. It is not exactly understood why these particular surfactants may be preferred for use, however the potassium cation is generally known in the art to be more soluble than other alkali metal salts, such as sodium. Further, it is possible that the carboxylate group in these surfactants are the reason for the compatibility between surfactant and peroxyacid molecules. It is also believed that increased stability may occur when these surfactants' alkyl chain groups are about the same length or slightly longer (i.e., at least one carbon more) than those of the peroxyacid. It is speculated that with proper alkyl chain length presence (i.e., a surfactant able to form a mixed micelle), the resulting energetically favorable mixed micelle formation contributes to the stability of the peroxyacid molecules. (see below, TABLES I-III).

Suitable nonionic surfactants may include linear and branched ethoxylated alcohols; linear and branched propoxylated alcohols; ethoxylated and propoxylated alcohols; polyoxyethylenes, alkyl polyoxypropylenes; alkylpolyoxyethylenes; alkylarylpolyoxyethylenes; ethoxylated alkylphenols; carboxylic acid esters such as glycerol esters of fatty acids, certain polyethylene glycol esters, anhydrosorbitol esters, ethoxylated anhydrosorbital esters, ethylene and methylene glycol esters, propanediol esters, and ethoxylated natural fats and oils (e.g., tallow oils, coco oils, etc.); carboxylic amides such as 1:1 amine acid diethanolamine condensates, 2:1 amine/acid diethanolamine condensates, and monoalkanolamine condensates such as ethanolamine condensates, and isopropanol-amine condensates, polyoxyethylene fatty acid amides; certain polyalkylene oxide block co-polymers such as polyoxypropylene-polyoxyethylene block co-polymers; and other miscellaneous nonionic surfactants such as organosilicones.

Cationic surfactants may also be suitable for inclusion in the invention. Cationic surfactants include a wide range of classes of compounds, including non-oxygen-containing alkyl mono-, di and polyamines, and resin derived amines; oxygen-containing amines, such as amine oxides (which appear to act as cationics in acidic solutions, and as nonionics in neutral or alkaline solutions); polyoxyethylene alkyl and alicyclic amines; substituted alkyl, alkylol imidazolines, such as 2-alkyl-1-(hydroxyethyl)-2-imidazolines; amide linked amines, and quaternary ammonium salts ("quats").

Further, suitable amphoteric surfactants containing both acidic and basic hydrophilic moieties in their structure, include alkyl betaines, amino-carboxylic acids and salts thereof, amino-carboxylic acid esters, and others.

Further examples of anionic, nonionic, cationic and amphoteric surfactants which may be suitable for use in this invention are depicted in Kirk-Othmer, *Encyclopedia of Chemical Technology,* Third Edition, Vol. 22, pages 347-387, and *McCutcheon's Detergents and Emulsifiers,* North American Edition, 1983, incorporated herein by reference.

Zwitterionic surfactants which may be suitable for use in the compositions of this invention may be broadly described as derivatives of secondary and tertiary amines, derivatives of heterocyclic secondary and tertiary amines, or derivatives of quaternary ammonium, quaternary phosphonium or tertiary sulfonium compounds. Suitable examples of these zwitterionic surfactants can be found described in Jones, U.S. Pat. No. 4,005,029, Columns 11-15, which are incorporated herein by reference.

Preferred ranges of the compositions of this invention comprising the above described peroxyacids and surfactants are as follows:

Peroxyacid: 1-100 ppm A.O., more preferably 1-50 ppm A.O., most preferably 1-25 ppm A.O. when in aqueous solution.

Surfactants: 1-10,000 ppm, more preferably 1-5,000 ppm, most preferably 1-1,000 ppm when in aqueous solution.

In order to deliver these amounts, it is preferred that a dry product contain about 0.1 to 20.0% by weight of the peroxyacid and about 0.01 to 80.0% by weight of the surfactant, the remainder comprising filler.

In yet a further embodiment of this invention, a buffer is present. These buffers may be selected from the alkali metal, ammonium and alkaline earth metal salts of borates, nitrates, iodates, hydroxides, carbonates, silicates or phosphates. Organic buffers such as TRIS, salts of tartaric, oxalic, phthalic, benzoic, succinic, citric, and maleic acids may also be suitable for use herein. The presence of these buffers may be useful in establishing desired pH ranges in the wash water or other aqueous system. Mixtures of these buffers may also be suitable. For the purposes of this invention, it appears that a pH range of 7-12 may be preferable. Differences in temperature may also affect the performances of the peroxyacids in this invention. For example, it was commonly assumed that higher temperatures may promote more rapid decomposition of the peroxyacids herein. However, with particular regard to alpha-substituted alkyl diperoxysuccinic acid, it was found that there was greater instability at 25° C. than at 37.8° C. and 54.5° C. Also, further adjuncts known to those skilled in the art may be included in these compositions.

EXPERIMENTAL

TABLES I-III below show the half-life values obtained for particular peroxyacids which were stabilized with surfactants. The surfactants used here included: sodium linear alkyl benzene sulfonate, fatty acids, and sodium alkyl sulfate; other anionic surfactants such as alkali metal salts of fatty acids (potassium myristate, potassium palmitate); and nonionic surfactants, such as Triton X-114 (trademark of Rohm & Haas for octylphenoxypoly(ethyleneoxy)ethanol) and Neodol 25-9 (trademark of Shell Chemical Company for linear ethoxylated alcohol with a predominant chain of 12-15 carbons and averaging 9 moles of ethylene oxide per mole of alcohol). Adjusting for use with buffer, all peroxyacids tested showed marked improvements in their half-lives when the surfactants were added.

Additionally, the preferred fatty acid salts provided especially increased stabilization for the peroxyacids surveyed. (See TABLE I, Examples 4,7; TABLE II, Example 19-22, 24-25).

The stable bleaching compositions of the invention could be put to commercial use as a stable dry bleach product. For example, the conditions under which these stable bleaching compositions were tested used "real-life" washing conditions, wherein commercial detergents, e.g., Tide® (Procter & Gamble Co.) and Fresh Start® (Colgate-Palmolive Co.) were added to wash water in amounts which follow prescribed usage. For the purposes of this invention, this is about 0.1 to 3.0 grams/liter, based on the dry weight of the detergent, with about 0.5 to 1.60 grams/liter normally the average usage.

The invention is further exemplified by the experimental data set forth below and by the claims hereto, although the applicants do not thereby intend to restrict the scope of their invention.

TABLE I

PERDECANOIC AND PERDODECANOIC ACID HALF-LIFE STABILIZATION BY SELECTED SURFACTANTS

| Example | Peroxyacid | Detergent | Temperature | Buffer | pH | Surfactant | Half-Life (Seconds) |
|---|---|---|---|---|---|---|---|
| 1 | Perdecanoic Acid[1] | Tide ®[2] | 21.1° C. | 0.1 M[3] | 9 | None | 1,500 |
| 2 | " | " | " | " | " | Lauric[4] Acid | 1,600 |
| 3 | " | " | " | " | " | Palmitic[5] Acid | 3,750 |
| 4 | " | " | " | " | " | Potassium[6] Myristate | 13,000 |
| 5 | Perdodecanoic Acid[1] | " | " | " | " | None | 260 |
| 6 | " | " | " | | " | Lauric[4] Acid | 3,500 |
| 7 | " | " | " | | " | Potassium[6] Myristate | 8,000 |

[1]Concentration was $1.25 \times 10^{-3}$ M or 20 ppm A.O.
[2]Tide ® is a registered trademark of Proctor & Gamble Co. 1.53 g/l were used.
[3]Buffer was 0.1 M $Na_2CO_3$.
[4]Lauric acid is a $C_{12}$ fatty acid, which, at this pH, forms a salt. About $2.5 \times 10^{-3}$ M was present.
[5]Palmitic acid is a $C_{16}$ fatty acid, which, at this pH, forms a salt. About $2.5 \times 10^{-3}$ M was present.
[6]Potassium myristate is a $C_{14}$ fatty acid monopotassium salt. About $2.5 \times 10^{-3}$ M was present.

TABLE II

ALKYL DIPEROXY SUCCINIC ACIDS STABILIZATION BY SELECTED SURFACTANTS

| Example | Peroxyacid | Detergent | Temperature | Hardness | pH | Surfactant | Half-life (Seconds) |
|---|---|---|---|---|---|---|---|
| 8 | Dodecyl Diperoxy[1] Succinic Acid | Tide ®[2] | 37.8° C. | 100 ppm[3] | 8.5 | None | 120 |
| 9 | Dodecyl Diperoxy[1] Succinic Acid | " | " | " | " | Niaproof[4] | 90 |
| 10 | Dodecyl Diperoxy[1] Succinic Acid | " | " | " | " | Polystep B-26[5] | 120 |
| 11 | Dodecyl Diperoxy[1] Succinic Acid | " | " | " | " | $C_{12}$ Alkyl Sulfate | 180 |
| 12 | Dodecyl Diperoxy[1] Succinic Acid | " | " | " | " | Sodium Laurate | 180 |
| 13 | Dodecyl Diperoxy[1] Succinic Acid | " | " | " | " | Calsoft F-90[6] | 185 |
| 14 | Dodecyl Diperoxy[1] Succinic Acid | " | " | " | " | Triton X-45[7] | 270 |
| 15 | Dodecyl Diperoxy[1] Succinic Acid | " | " | " | " | Alfonic 1412-40[8] | 300 |
| 16 | Dodecyl Diperoxy[1] Succinic Acid | " | " | " | " | Triton X-114[9] | 330 |
| 17 | Dodecyl Diperoxy[1] Succinic Acid | " | " | " | " | Alfonic 1618-65[10] | 390 |
| 18 | Dodecyl Diperoxy[1] Succinic Acid | " | " | " | " | Neodol 25-9[11] | 450 |
| 19 | Dodecyl Diperoxy[1] Succinic Acid | " | " | " | " | Potassium Stearate[12] | 600 |
| 20 | Dodecyl Diperoxy[1] Succinic Acid | " | " | " | " | Potassium Palmitate[13] | 790 |
| 21 | Dodecyl Diperoxy[1] Succinic Acid | " | " | " | " | Sodium Myristate[14] | 900 |
| 22 | Dodecyl Diperoxy[1] Succinic Acid | " | " | " | " | Potassium Myristate[15] | 1080 |
| 23 | Decyl Diperoxy[1] Succinic Acid | " | " | " | " | None | 240 |
| 24 | Decyl Diperoxy[1] Succinic Acid | " | " | " | " | Potassium Myristate[15] | 560 |
| 25 | Decyl Diperoxy[1] Succinic Acid | " | " | " | " | Potassium Palmitate[13] | 600 |

[1]Concentration was $6.25 \times 10^{-4}$ M or 20 ppm A.O.
[2]Tide ® is a trademark of the Proctor & Gamble Company. 1.53 g/liter were used.
[3]Hardness: measured as $CaCO_3$.
[4]Trademark of Niaset Chemicals for $C_{14}$ alkyl sulfate. Each of the following surfactants was present at about 1.41 g/ 3 liters solution (100% active), or about 470 ppm.
[5]Trademark of Stepan Chemicals for $C_{16-18}$ alkyl sulfate.
[6]Trademark of Pilot Chemical Co. for $C_{11.3}$ alkyl benzene sulfonate.
[7]Trademark of Rohm and Haas for octylphenol -4- ethoxylate.
[8]Trademark of Conoco Chemical Co. for $C_{12-14}$ alcohol ethoxylate sulfate.
[9]Trademark of Rohm and Haas for octylphenol -8- ethoxylate.
[10]Trademark of Conoco Chemical Co. for $C_{16-18}$ alcohol -8- ethoxylate.
[11]Trademark of Shell Chemical Co. for $C_{12-15}$ alcohol -9- ethoxylate.
[12]$C_{18}$ fatty acid monopotassium salt.
[13]$C_{16}$ fatty acid monopotassium salt.
[14]$C_{14}$ fatty acid monosodium salt.
[15]$C_{14}$ fatty acid monopotassium salt.

TABLE III

PERDECANOIC ACID HALF LIFE STABILIZATION BY SELECTED SURFACTANTS

| Example | Peroxyacid | Detergent | Temperature | Buffer | pH | Surfactant | Half-Life (Seconds) |
|---|---|---|---|---|---|---|---|
| 26 | Perdecanoic[1] | Fresh Start[2] | 21.1° C. | 0.1 M[3] | 9 | None | 4,300 |
| 27 | " | " | " | " | " | Neodol 25-7[4] | 5,100 |
| 28 | " | " | " | " | " | Sodium Lauryl[5] Sulfate | 5,500 |
| 29 | " | " | " | " | " | Myristic Acid[6] | 9,000 |

[1]Concentration was $1.25 \times 10^{-3}$ M or 20 ppm A.O..
[2]Fresh Start is a trademark of Colgate-Palmolive Co. for detergent containing nonionic surfactant. Present at 0.5 g/liter.
[3]Buffer was $Na_2CO_3$ at 0.1 M.
[4]Trademark of Shell Chemical Co. for linear alcohol ethoxylate with a predominant chain length of 12–15 carbons, and averaging 7 moles of ethylene oxide per mole of alcohol. Present at about $2.5 \times 10^{-3}$ M.
[5]Sodium dodecyl sulfate, anionic surfactant. Present at about $2.5 \times 10^{-3}$ M.
[6]Myristic acid at this pH forms fatty acid salt. Present at about $2.5 \times 10^{-3}$ M.

What is claimed is:

1. A substantially nonaqueous stable peroxyacid bleach composition comprising:

(a) an amount of a surface active peroxyacid sufficient to produce 1–100 ppm A.O. in aqueous solution, which tends to undergo extremely rapid solution decomposition in aqueous solution; and (b) an amount of at least one surfactant sufficient to produce 1–10,000 ppm surfactant in aqueous solution in order to form a mixed micelle with the peroxyacid;

wherein said aqueous solution contains a commercial laundry detergent in a concentration of about 0.1 to 3.0 grams/liter.

2. The stable peroxyacid bleach composition of claim 1 wherein said surfactant is selected from anionic, nonionic, amphoteric, zwitterionic surfactants, and mixtures thereof.

3. The stable peroxyacid bleach composition of claim 1 wherein said peroxyacid comprises about 0.1 to 20.0% by weight and said surfactant comprises 0.01 to 80.0% by weight.

4. The stable peroxyacid bleach composition of claim 1 further comprising a buffer.

5. The stable peroxyacid bleach of claim 4 wherein said buffer is selected from the alkali metal, ammonium, and alkaline earth salts of borates, nitrates, iodates, hydroxides, carbonates, silicates, and phosphates; organic buffers; and mixtures thereof.

6. A substantially nonaqueous stable peroxyacid bleach composition comprising:

(a) an amount of a surface active peroxyacid having a carbon chain of from about 6 to 20 carbon atoms sufficient to produce 1–100 ppm A.O. in aqueous solution, said peroxyacid tending to undergo extremely rapid solution decomposition in aqueous solution;

(b) an amount of at least one surfactant sufficient to produce 1–10,000 ppm surfactant in aqueous solution, said surfactant forming a mixed micelle aqueous solution with said peroxyacid, said mixed micelle resulting in decreased peroxyacid decomposition rates and increased peroxyacid half-life; and (c) a buffer to keep the composition within the range of pH 7–12 when in aqueous solution with detergent;

wherein said aqueous solution contains a commercial laundry detergent concentration of about 0.1 to 3.0 grams/liter.

7. The stable peroxyacid bleach composition of claim 6 wherein said surfactant is selected from anionic, nonionic, amphoteric, zwitterionic surfactants, and mixtures thereof.

8. The stable peroxyacid bleach composition of claim 6 wherein said peroxyacid is selected from:

alpha substituted alkyl diperoxysuccinic acids and alpha or beta monoperoxysuccinic acids of about 6 to 20 carbon atoms in the alkyl group; straight chain monoperoxyacids of about 6 to 20 carbon atoms in the carbon chain; substituted or unsubstituted arylperoxy acids with an alkyl group of about 6 to 20 carbon atoms; and mixtures thereof.

9. The stable peroxyacid bleach composition of claim 7 wherein said surfactant is selected from alkyl fatty acids, their alkali metal salts and mixtures thereof.

10. The stable peroxyacid bleach composition of claim 9 wherein said surfactant has an alkyl chain containing a number of carbons approximately greater than or equal to the peroxyacid's carbon chain.

11. The stable peroxyacid bleach composition of claim 10 wherein said surfactant is selected from lauric, myristic, palmitic and stearic acid, their alkali metal salts and mixtures thereof.

12. The stable peroxyacid bleach composition of claim 11 wherein said alkali metal salt is potassium.

13. A method for stablizing the solution decomposition rate of substantially nonaqueous peroxyacids comprising:

(a) combining an amount of a surface active peroxyacid sufficient to produce 1–100 ppm A.O. in aqueous solution, said peroxyacid tending to undergo extremely rapid solution decomposition in aqueous solution, with an amount of at least one surfactant sufficient to produce 1–10,000 ppm surfactant in aqueous solution; and (b) forming a mixed micelle therebetween in aqueous solution, said mixed micelle causing decreased peroxyacid decomposition rates and increased peroxyacid half-life, said peroxyacid and said surfactant of the combination in (a) being substantially nonaqueous;

wherein said aqueous solution contains a commercial laundry detergent concentration of about 0.1 to 3.0 grams/liter.

14. The method of claim 13 wherein said surfactant is selected from anionic, nonionic, amphoteric, zwitterionic surfactants, and mixtures thereof.

15. The method of claim 13 wherein said peroxyacid comprises about 0.1 to 20.0% by weight and said surfactant comprises about 0.01 to 80.0% by weight.

16. The method of claim 13 further comprising the step (c) adding a buffer.

17. The method of claim 16 wherein said buffer is selected from the alkali metal, ammonium, and alkaline earth salts of borates, nitrates, iodates, hydroxides, carbonates, silicates, phosphates; organic buffers; and mixtures thereof.

18. The method of claim 13 wherein said peroxyacid has a carbon chain of from about 6 to 20 carbon atoms.

19. The method of claim 13 wherein said peroxyacid is selected from:

alpha substituted alkyl diperoxysuccinic acids and alpha or beta monoperoxysuccinic acids of about 6 to 20 carbon atoms in the alkyl chain; straight chain monoperoxyacids of about 6 to 20 carbon atoms in the carbon chain; substituted or unsubstituted arylperoxy acids with an alkyl group of about 6 to 20 carbon atoms; and mixtures thereof.

20. A method for bleaching soiled fabrics comprising:

treating a soiled fabric with a substantially nonaqueous composition which comprises:

(a) an amount of a surface active peroxyacid sufficient to produce 1–10 ppm A.O. in aqueous solution, said peroxyacid tending to undergo extremely rapid solution decomposition in aqueous solution;

(b) an amount of at least one surfactant sufficient to produce 1–10,000 ppm A.O. in aqueous solution, said surfactant forming a mixed micelle in aqueous solution with said peroxyacid, said mixed micelle causing decreased decomposition rates and increased peroxyacid half-life said (a) and said (b) of said composition being substantially nonaqueous; and removing the soil from said soiled fabric;

wherein said aqueous solution contains a commercial laundry detergent concentration of about 0.1 to 3.0 grams/liter.

21. The method of claim 20 wherein said surfactant is selected from anionic, nonionic, amphoteric, zwitterionic surfactants, and mixtures thereof.

22. The method of claim 20 wherein said composition further comprises (c) a buffer.

23. The method of claim 21 wherein said buffer is selected from alkali metal, ammonium, and alkaline earth salts of borates, nitrates, iodates, hydroxides, carbonates, silicates, phosphates; organic buffers; and mixtures thereof.

24. The method of claim 20 wherein said peroxyacid has a carbon chain of from about 6 to 20 carbon atoms.

25. The method of claim 24 wherein said peroxyacid is selected from: alpha substituted alkyl diperoxysuccinic acids and alpha or beta monoperoxysuccinic acids of about 6 to 20 carbon atoms in the alkyl chain; straight chain monoperoxyacids of about 6 to 20 carbon atoms in the carbon chain; substituted or unsubstituted arylperoxy acids with an alkyl group of about 6 to 20 carbon atoms; and mixtures thereof.

* * * * *